US008194024B2

(12) United States Patent
Baek et al.

(10) Patent No.: US 8,194,024 B2
(45) Date of Patent: Jun. 5, 2012

(54) APPARATUS AND METHOD FOR DISTINGUISHING PANEL OF DISPLAY DEVICE

(75) Inventors: Seung-Jun Baek, Seoul (KR); Kyung-Jin Ha, Gumi-si (KR); Jae-Sik Jo, Daegu (KR); Jeong-Hyun Oh, Daegu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 605 days.

(21) Appl. No.: 12/389,341

(22) Filed: Feb. 19, 2009

(65) Prior Publication Data

US 2009/0225092 A1 Sep. 10, 2009

(30) Foreign Application Priority Data

Mar. 5, 2008 (KR) ..... 10-2008-0020595

(51) Int. Cl.
*G09G 3/36* (2006.01)

(52) U.S. Cl. ..... 345/98

(58) Field of Classification Search ..... None
See application file for complete search history.

(56) References Cited

U.S. PATENT DOCUMENTS

2003/0169222 A1* 9/2003 Burkhardt ..... 345/87

FOREIGN PATENT DOCUMENTS

| | | |
|---|---|---|
| EP | 1 320 084 A2 | 6/2003 |
| EP | 1 345 197 A1 | 9/2003 |
| EP | 1 564 708 A2 | 8/2005 |

* cited by examiner

*Primary Examiner* — Paul Huber
(74) *Attorney, Agent, or Firm* — Jefferson IP Law, LLP

(57) ABSTRACT

An apparatus and method for distinguishing a panel of a display device is provided. A driver Integrated Circuit (IC) of the display device includes a plurality of pins that are electrically connected differently according to a type of the panel, and an output pin for outputting an output signal indicating a type of the panel according to an electric connection between the plurality of pins. A controller determines a type of the panel depending on the output signal provided from the driver IC, and applies a control signal corresponding to the determined type of the panel to the driver IC.

20 Claims, 10 Drawing Sheets

APPARATUS AND METHOD FOR DISTINGUISHING PANEL OF DISPLAY DEVICE

PRIORITY

This application claims the benefit under 35 U.S.C. §119 (a) of a Korean Patent Application filed in the Korean Intellectual Property Office on Mar. 5, 2008 and assigned Serial No. 10-2008-0020595, the entire disclosure of which is hereby incorporated by reference.

BACKGROUND OF THE INVENTION

1. Field of the Invention

The present invention relates to a display device. More particularly, the present invention relates to an apparatus and method for distinguishing a panel of a display device.

2. Description of the Related Art

Increased competition among mobile terminal manufacturers has remarkably reduced the development cycle of mobile terminals and has further diversified the types of mobile terminals being developed. To follow this trend, the manufacturers are replacing type-specific parts, which are used in mobile terminals based on their types, with universal parts that can be used for all mobile terminals regardless of their types. With the availability of the universal parts, the mobile terminal manufacturers can more rapidly develop various new models of mobile terminals, securing their product competitiveness.

In manufacturing mobile terminals with the universal parts, the mobile terminal manufacturers may be provided with the same parts from several suppliers to balance the supply and demand of goods, and a display unit (e.g. a Liquid Crystal Display (LCD) module) is an example of one of the universal parts for mobile terminals. In order to use the universal parts such as the display unit, the characteristics of which may differ according to supplier, for mobile terminals regardless of their types, it is necessary to distinguish types of display units made by different suppliers and apply the proper settings to the distinguished display units.

The conventional technology for distinguishing types of display units made by different suppliers provides a method for writing unique IDentifiers (IDs) of the display units in a Random Access Memory (RAM) mounted on a display unit module, and checking the IDs written in the RAM. However, the conventional technology may increase the cost and size of the display unit due to the memory being mounted in the display unit. In addition, because the display units are supplied from several suppliers in a mixed way, IDs used to identify the display units may be incorrect. Further, a separate process of writing the IDs should be performed, and when the types of the panels, or display units, are changed, the process of writing the IDs should be carried out again, which may cause a delay in the product manufacturing process and an a reduction in product shipments.

Further, the conventional technology provides a method for adding particular pins and for distinguishing types of display units through the added pins. However, this method may increase the volume of a Flexible Printed Circuit Board (FPCB) and connectors, provided to connect the display unit to a controller of the mobile terminal, causing an increase in the cost of the product.

SUMMARY OF THE INVENTION

An aspect of the present invention is to address at least the above-mentioned problems and/or disadvantages and to provide at least the advantages described below. Accordingly, an aspect of the present invention is to provide an apparatus and method capable of distinguishing a type of a display device without adding separate RAM or pins.

In accordance with one aspect of the present invention, an apparatus for distinguishing a panel of a display device is provided. The apparatus includes a driver Integrated Circuit (IC) of the display device, which includes a plurality of pins that are electrically connected differently according to a type of the panel, and an output pin for outputting an output signal indicating a type of the panel according to an electric connection between the plurality of pins, and a controller for determining a type of the panel depending on the output signal provided from the driver IC, and for applying a control signal corresponding to the determined type of the panel to the driver IC.

In accordance with another aspect of the present invention, a method for distinguishing a panel of a display device is provided. The method includes outputting, by a driver IC to which a panel is joined and on which a metal pattern is formed, an output signal that is changed according to a type of the metal pattern, determining, by a controller, a type of the panel depending on the output signal, and applying, by the controller, a control signal corresponding to the determined type of the panel to the driver IC.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
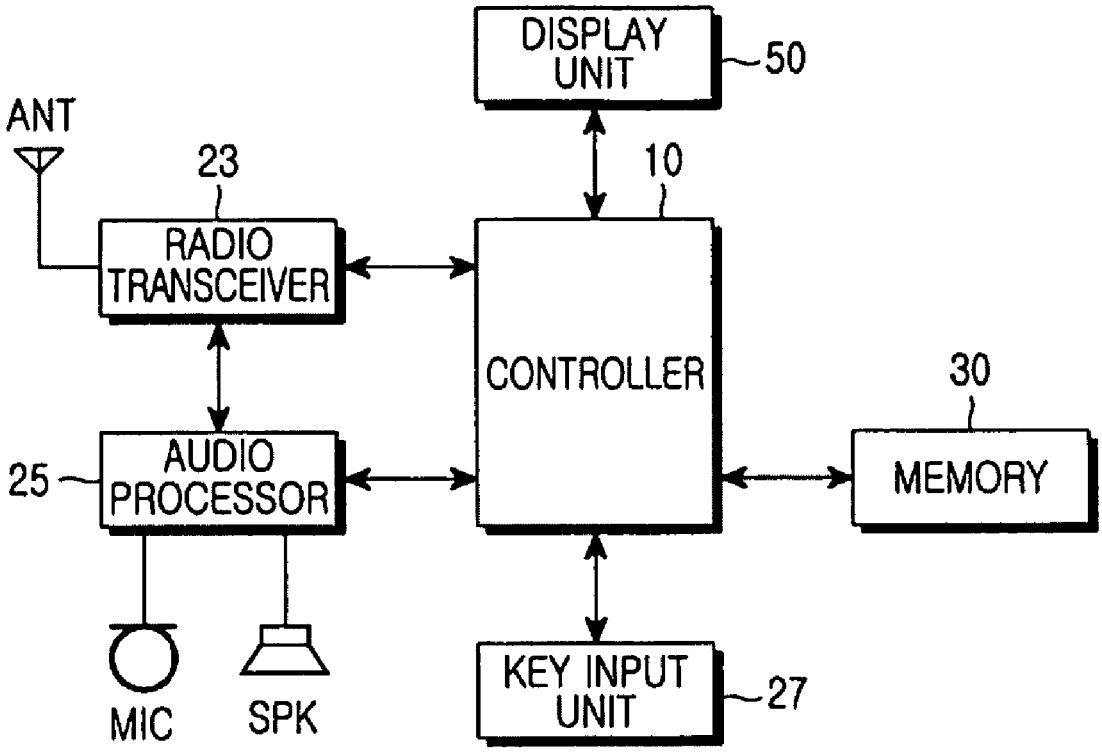
FIG. 1 is a block diagram illustrating an apparatus for distinguishing a panel of a display device according to an exemplary embodiment of the present invention.

FIG. 1 is a block diagram illustrating an apparatus for distinguishing a panel of a display device according to an exemplary embodiment of the present invention, in which the display device is assumed to be a display unit used for a mobile terminal.

Referring to FIG. 1, a controller 10 controls overall operations of the mobile terminal, including a switching operation of drive modes. In an exemplary implementation, the controller 10 may be adapted to determine a type of a panel of a display unit 50 depending on an output signal provided from a driver Integrated Circuit (IC) 51 (see FIGS. 4A, 5A and 6A) of the display unit 50, and apply a control signal for the determined panel to the driver IC 51.

A radio transceiver 23 includes a Radio Frequency (RF) unit (not shown) and a modulator-demodulator (modem) (not shown). The RF unit includes an RF transmitter for up-converting a frequency of transmission signals and amplifying the up-converted signals, and an RF receiver for low-noise amplifying received signals and down-converting a frequency of the low-noise amplified signals. The modem includes a transmission unit for encoding and modulating transmission signals, and a reception unit for demodulating and decoding signals received from the RF unit.

An audio processor 25 may include a codec (not shown), which may include a data codec and an audio codec. The data codec handles packet data, or the like, and the audio codec processes audio signals, including voice, a multimedia file, etc. The audio processor 25 converts a digital audio signal received from the modem into an analog signal by means of the audio codec, and replays the analog signal. In addition, the audio processor 25 converts an analog audio signal created from a microphone (MIC) into a digital audio signal using the audio codec, and transfers the digital audio signal to the modem. The codec can be provided separately, or can be included in the controller 10.

A key input unit 27 includes alphanumeric keys (not shown) used for entering numeric and text information, and function keys (not shown) used to set a variety of functions. Here, the key input unit 27 can include a touch sensor (not shown). In this case, the key input unit 27 can receive a key input through the touch by the user.

A memory 30 may include a program memory and a data memory. The program memory may be provided to store a program for controlling overall operations of the mobile terminal. In an exemplary implementation, the memory 30 stores information about a type of each panel corresponding to an output signal provided from the driver IC 51 of the display unit 50, or display device.

The display unit 50 outputs, or displays, various display information generated by the mobile terminal. The display unit 50 may include a Liquid Crystal Display (LCD), Organic Light Emitting Diodes (OLED), or the like. The display unit 50, or display device, may include a panel (e.g. an LCD panel), a driver IC (e.g. an LCD driver IC), a Flexible PCB (FPCB), a backlight, etc. The driver IC 51 may be joined to the panel using a junction technique such as Tape Carrier Package (TCP), Chip-On Film (CoF), Chip-On Glass (CoG), etc. and drives the panel so that texts and images may be displayed thereon. The panels may be different in response time and screen characteristics (e.g. brightness, contrast, etc.) according to their manufacturers.

The display unit 50 according to an exemplary embodiment of the present invention will now be described with reference to FIGS. 3A through 6B, with a focus on the driver IC, the FPCB and the panel.

For convenience of the description, FIGS. 3A, 4A, 5A and 6A show only the pins applied to an exemplary embodiment of the present invention, among the numerous pins included in the driver IC 51. The driver IC 51 includes several tens of pins used for its operation, and only a few of them are used for testing an operation of the driver IC itself. In an exemplary implementation, the driver IC 51 uses test pins provided for testing its own operation as pins by which it can distinguish the panel, and these pins include a power pin 51*a*, two test pins 51*b* and 51*c*, two ground pins 51*d* and 51*e*, and an output pin 51*f*. Thus, in the driver IC 51, the power pin 51*a*, the test pins 51*b* and 51*c*, and the ground pins 51*d* and 51*e* are electrically connected in various patterns according to a type of the metal pattern formed on the panel, and an output signal generated by the electric connections between the pins may be output through the output pin 51*f*. As a result, the display unit 50 or the driver IC 51 does not need to include separate pins or RAM to distinguish a type of the panel.

Regarding the panel according to an exemplary embodiment of the present invention, a metal pattern is formed on the panel differently according to a type of the panel. The metal pattern formed on the panel electrically connects the pins in the driver IC 51 when the junction between the panel and the driver IC 51 is made, and if a type of the metal pattern formed on the panel is changed, the pins electrically connected in the driver IC 51 are also subject to change. Thereafter, when the electrically connected pins are changed according to the type of the metal pattern, the output signal provided from the driver IC 51 is also changed. As a result, a type of the panel joined to the driver IC 51 can be determined by checking the output signal provided from the driver IC 51.

Figure 3A:
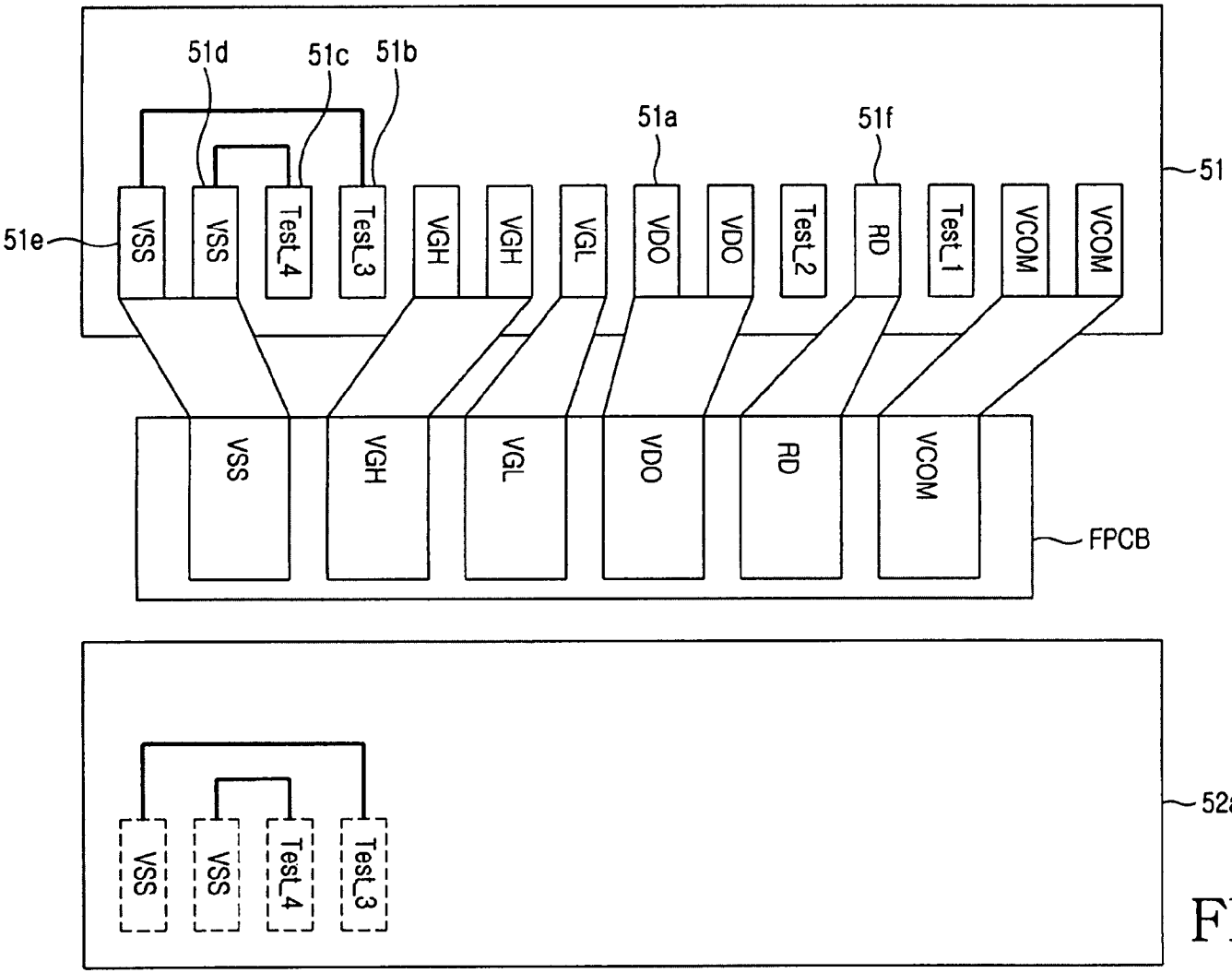
FIGS. 3A and 3B are diagrams illustrating a first exemplary process of distinguishing a panel of a display device according to an exemplary embodiment of the present invention.
Figure 3B:
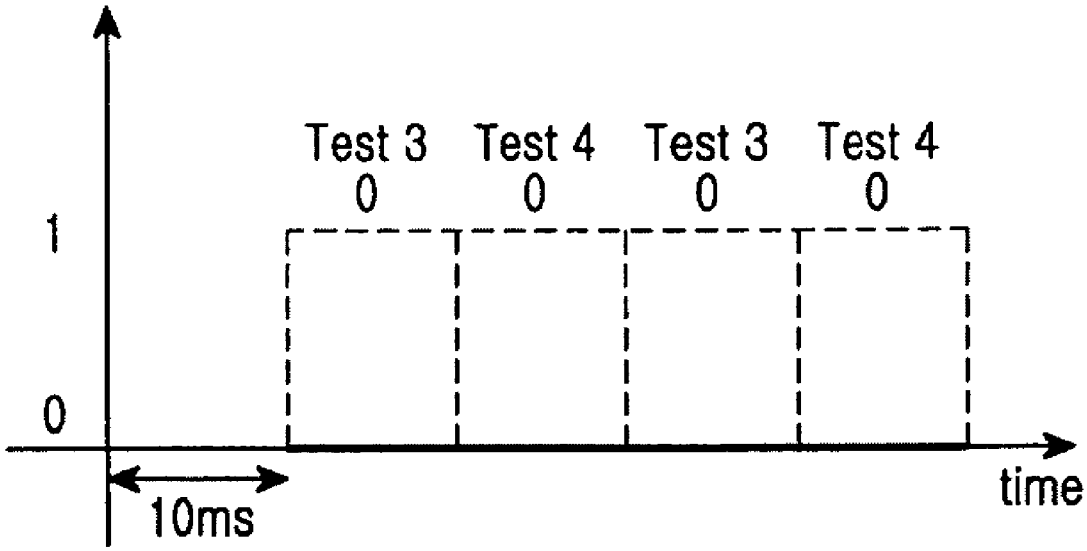
Figure 4A:
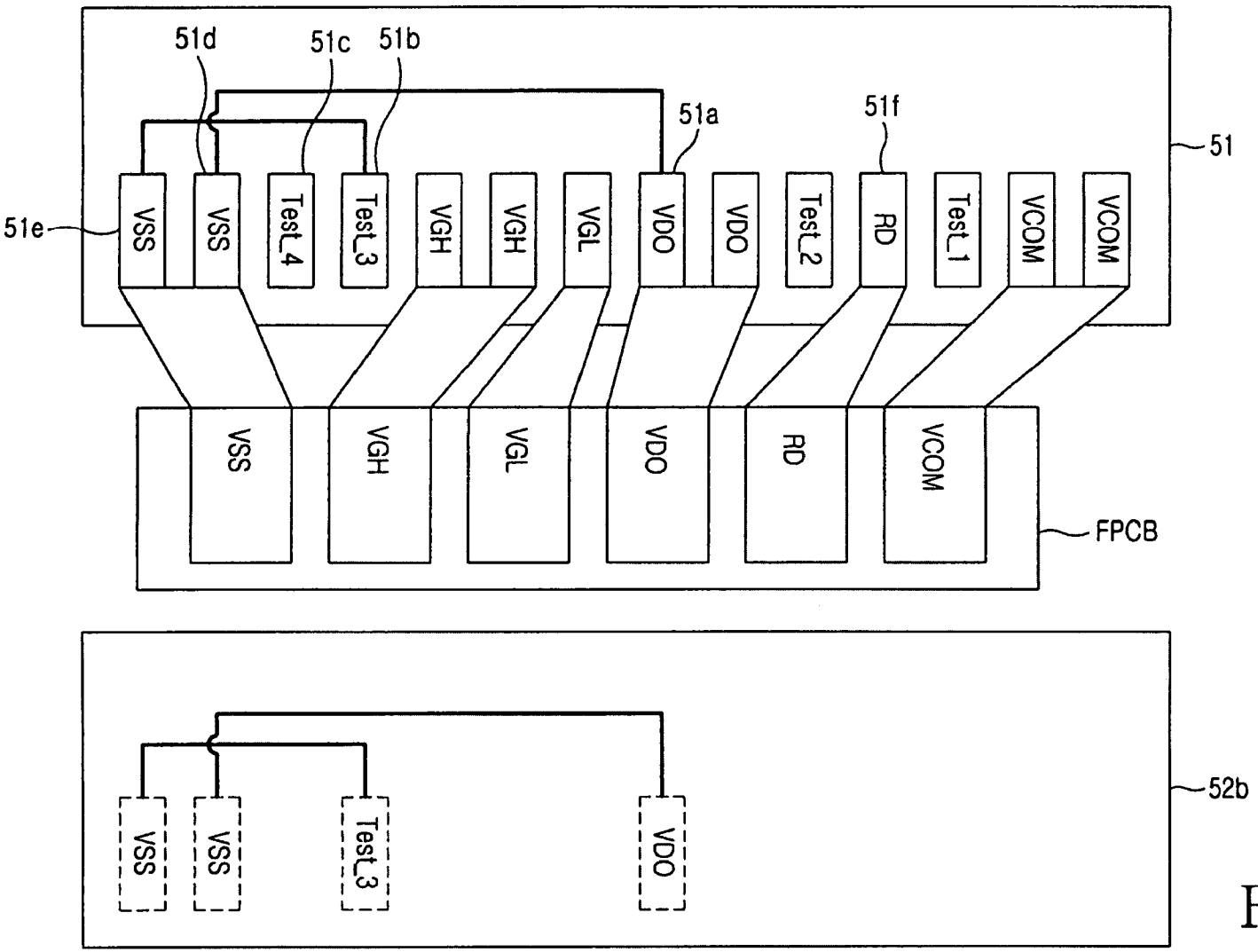
FIGS. 4A and 4B are diagrams illustrating a second exemplary process of distinguishing a panel of a display device according to an exemplary embodiment of the present invention.
Figure 4B:
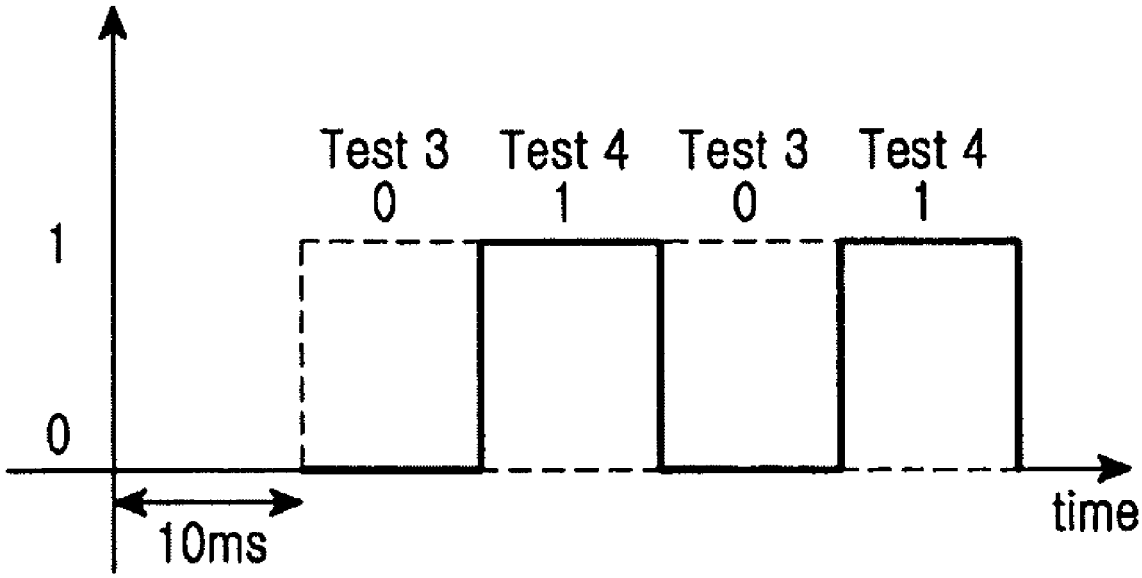
Figure 5A:
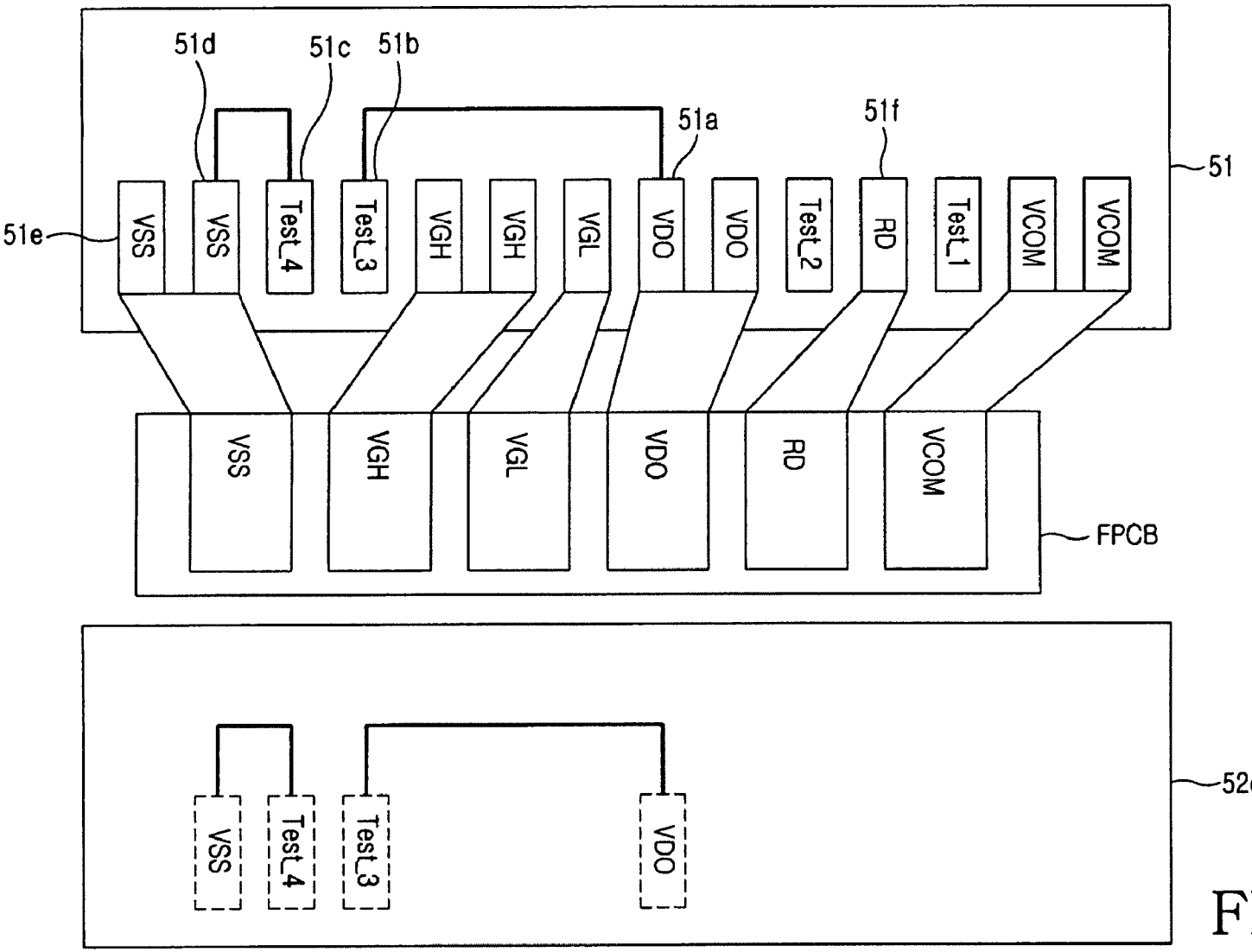
FIGS. 5A and 5B are diagrams illustrating a third exemplary process of distinguishing a panel of a display device according to an exemplary embodiment of the present invention.
Figure 5B:
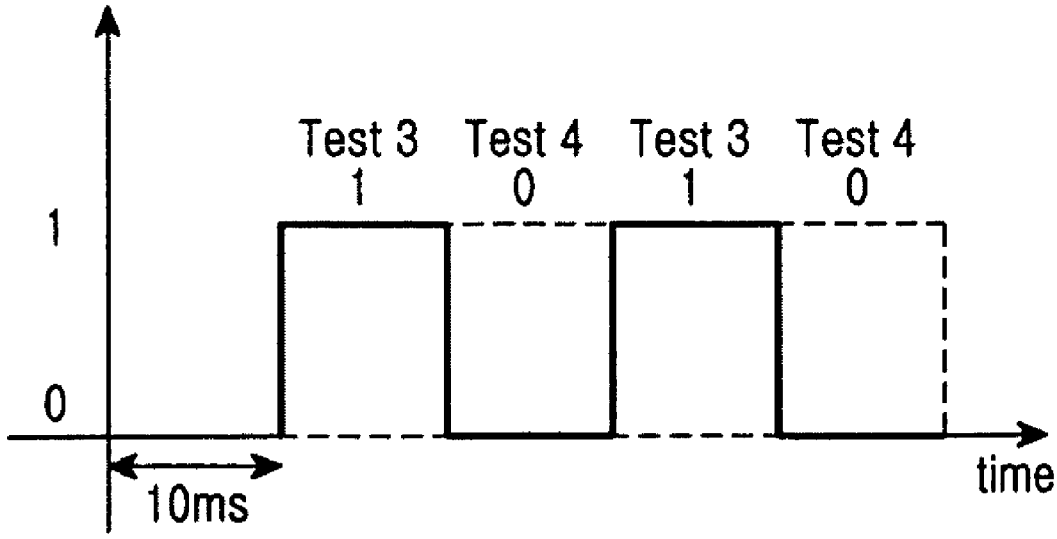
Figure 6A:
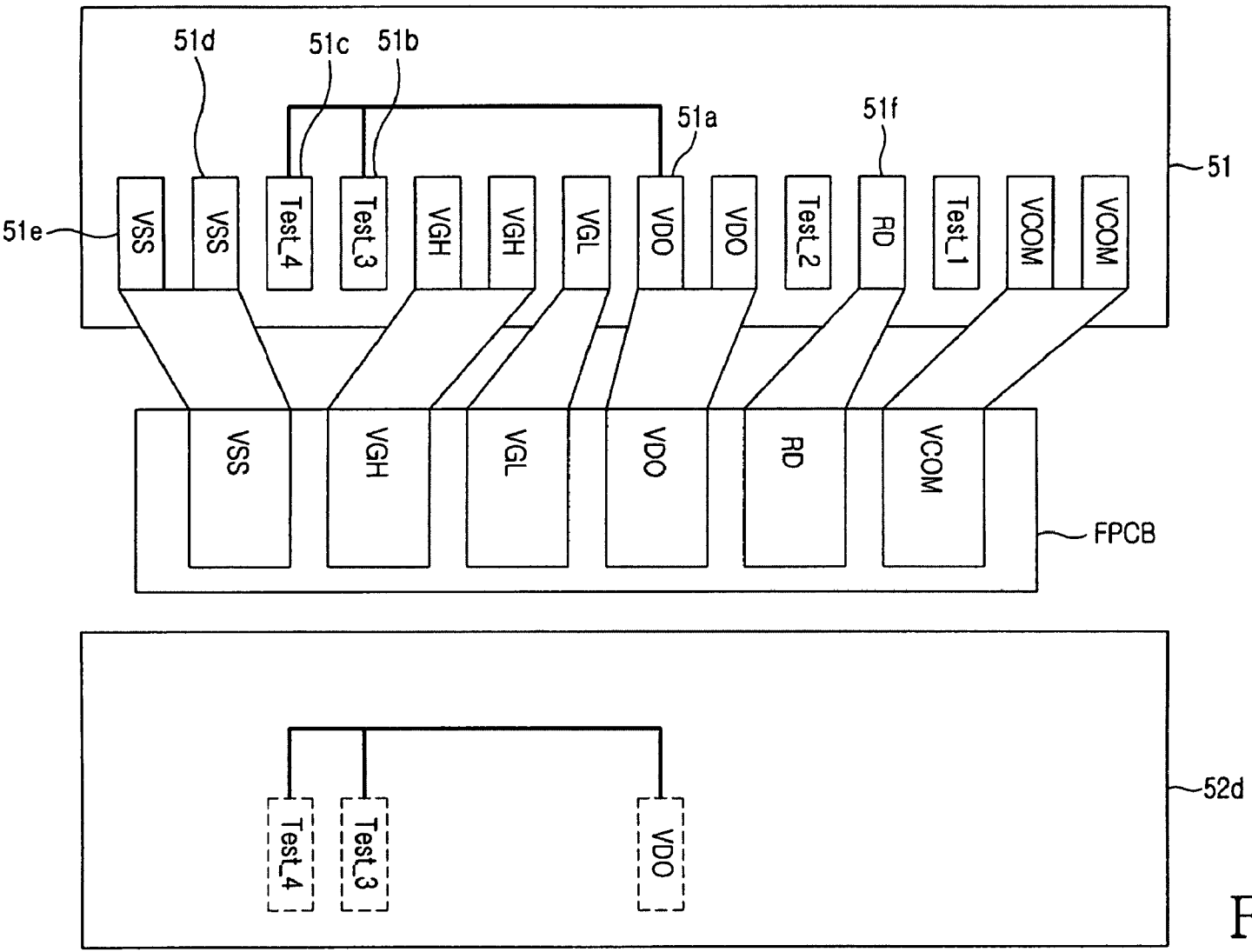
FIGS. 6A and 6B are diagrams illustrating a fourth exemplary process of distinguishing a panel of a display device according to an exemplary embodiment of the present invention.
Figure 6B:
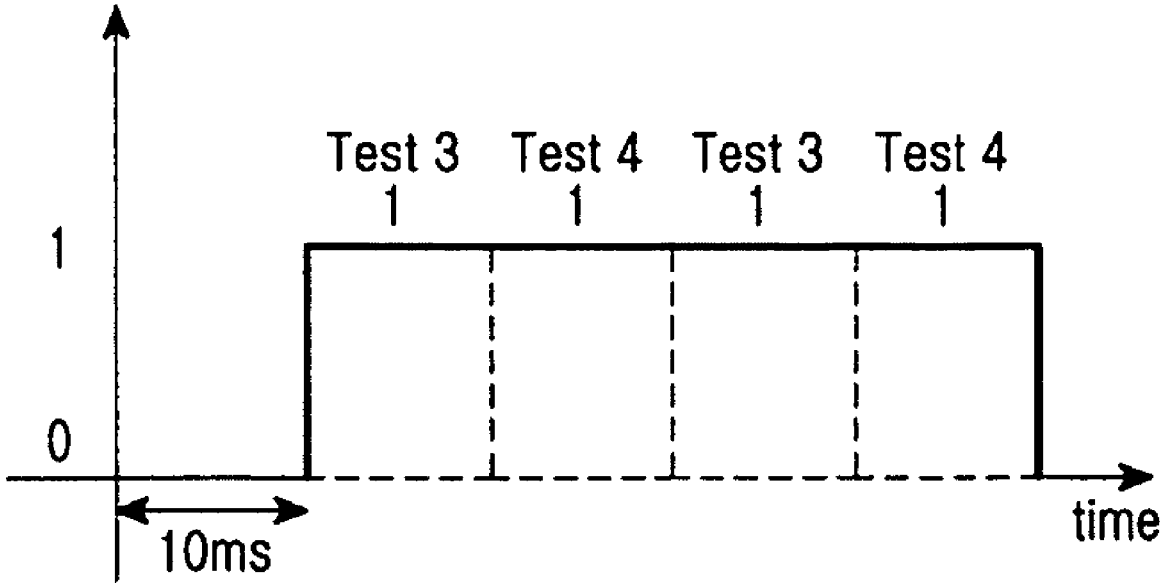

For example, FIG. 3A illustrates a panel 52*a* on which a metal pattern is formed that electrically connects a test pin 51*b* to a ground pin 51*e* and a test pin 51*c* to a ground pin 51*d* in the driver IC 51, and FIG. 3B illustrates an output signal of the driver IC 51, generated by the electric connection between the test pin 51*b* and the ground pin 51*e* and the electric connection between the test pin 51*c* and the ground pin 51*d*. In addition, FIG. 4A illustrates a panel 52*b* on which a metal pattern is formed that electrically connects the test pin 51*b* to the ground pin 51*e* and the power pin 51*a* to the ground pin 51*d* in the driver IC 51, and FIG. 4B illustrates an output signal of the driver IC 51, generated by the electric connection between the test pin 51*b* and the ground pin 51*e* and the electric connection between the power pin 51*a* and the ground pin 51*d*. FIG. 5A illustrates a panel 52*b* on which a metal pattern is formed that electrically connects the power pin 51*a* to the test pin 51*b* and the test pin 551*c* to the ground pin 51*d* in the driver IC 51, and FIG. 5B illustrates an output signal of the driver IC 51, generated by the electric connection between the power pin 51*a* and the test pin 51*b* and the electric connection between the test pin 51*c* and the ground pin 51*d*. FIG. 6A illustrates a panel 52*b* on which a metal pattern is formed that electrically connects the power pin 51*a*, the test pin 51*b*, and the test pin 51*c* in the driver IC 51, and FIG. 6B illustrates an output signal of the driver IC 51, generated by the electric connection between the power pin 51*a*, the test pin 51*b*, and the test pin 51*c*.

Figure 2:
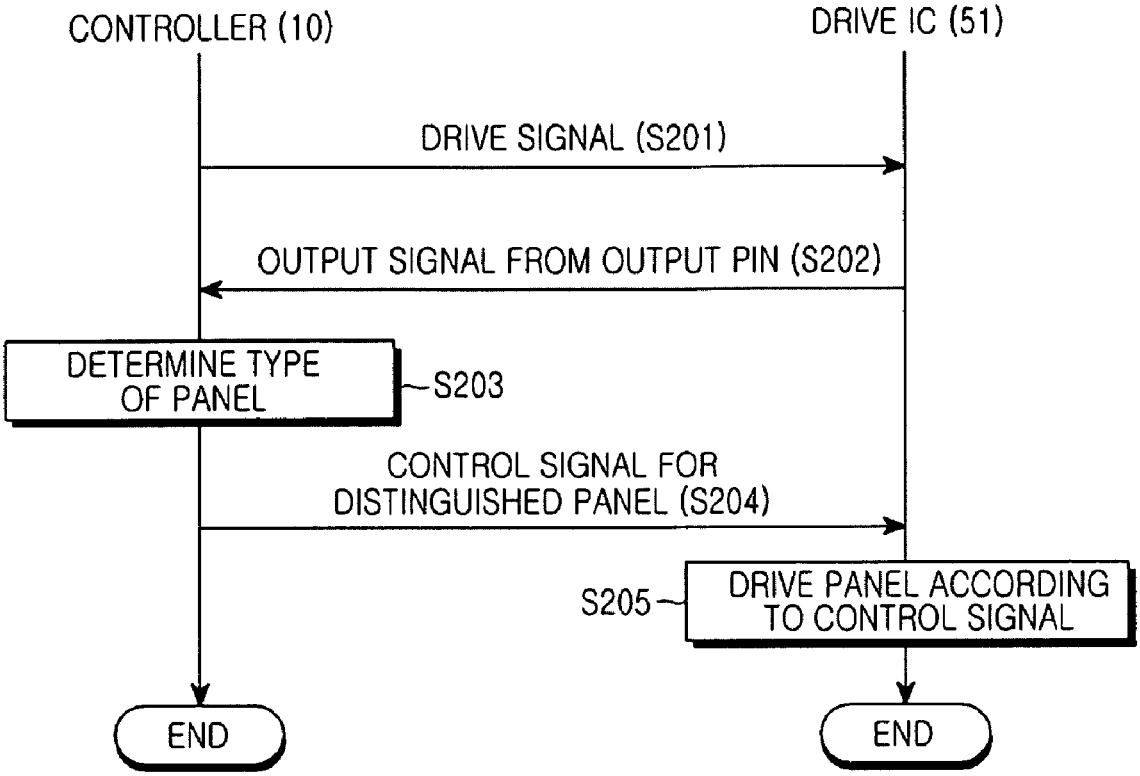
FIG. 2 is a signaling diagram illustrating a process of distinguishing a panel of a display device according to an exemplary embodiment of the present invention.

FIG. 2 is a signaling diagram illustrating a process of distinguishing a panel of a display device according to an exemplary embodiment of the present invention, and a description thereof will be given below with reference to FIGS. 3A to 6B.

When a drive signal is applied from a controller 10 to a driver IC 51 in step S201, the driver IC 51 transfers its output signal to the controller 10 through an output pin 51*f* in step S202.

Regarding the driver IC 51 shown in FIG. 3A, when a drive signal is applied from the controller 10 to the driver IC 51 through an FPCB, the driver IC 51 generates an output signal in which two test pins 51*b* and 51*c* both have a value of '0', after a lapse of a predefined time (e.g. 10 ms) since the receipt of the drive signal, as shown in FIG. 3B. This is because the two test pins 51*b* and 51*c* are electrically connected to the ground pins 51*d* and 51*e* as shown in FIG. 3A by the metal pattern formed on the panel 52*a*. Similarly, when a drive signal is applied to the driver IC 51 to which the panel 52*b* shown in FIG. 4A is joined, an output signal shown in FIG. 4B is output. When a drive signal is applied to a driver IC 51 to which a panel 52*c* shown in FIG. 5A is joined, an output signal shown in FIG. 5B is output. When a drive signal is applied to a driver IC 51 to which a panel 52*d* shown in FIG. 6A is joined, an output signal shown in FIG. 6B is output.

The controller 10 determines a type of the panel depending on the output signal in step S203, and applies a control signal corresponding to the determined panel to the driver IC 51 in step S204.

The controller 10 checks the output signal, which is provided from the output pin 51*f* through the FPCB connected to the driver IC 51, and determines a type of the panel corresponding to the output signal by referring to the memory 30. For example, the controller 10 identifies a type of the panel of the display unit 50, or display device, connected to the mobile terminal, by consulting the memory 30 in which information on various panels corresponding to the output signals of FIGS. 3B, 4B, 5B and 6B are stored. Thereafter, the controller 10 applies a control signal corresponding to the identified type of the panel to the driver IC 51 through the FPCB.

Thereafter, the driver IC 51 drives the panel according to the control signal received from the controller 10 in step S205.

The driver IC 51 receives a control signal corresponding to the panel joined thereto from the controller 10 through the FPCB, and drives the panel according to the received control signal. For example, the driver IC 51 can set a resolution (e.g. QQVGA (160×120), QCIF (176×144), QCIF+(176×200), QVGA (320×240), CIF (352×288), VGA (640×480) and XGA (1,024×768)), the number of letters per line, brightness, contrast, etc. depending on the received control signal. In addition, the controller 10 can output at least one of acoustic information and visual information indicating of the user that the type of the panel has been determined.

As is apparent from the foregoing description, exemplary embodiments of the present invention can distinguish a panel of a display device without having to additionally mount RAM or pins, thereby making it possible to simplify the manufacturing process of mobile terminals and reduce manufacturing cost.

While the invention has been shown and described with reference to a certain exemplary embodiments thereof, it will be understood by those skilled in the art that various changes in form and details may be made therein without departing from the spirit and scope of the invention as defined by the appended claims and their equivalents.

What is claimed is:

1. An apparatus for distinguishing a panel of a display device, the apparatus comprising:

a driver Integrated Circuit (IC) of a display device, which includes a plurality of pins that are electrically connected differently according to a type of the panel, and an output pin for outputting an output signal indicating a type of the panel according to an electric connection between the plurality of pins; and a controller for determining a type of the panel depending on the output signal provided from the driver IC, and for applying a control signal corresponding to the determined type of the panel to the driver IC.

2. The apparatus of claim 1, wherein the plurality of pins are electrically connected differently according to a type of a metal pattern formed on the panel.

3. The apparatus of claim 1, wherein the controller outputs at least one of acoustic information and visual information indicating that the type of the panel has been determined.

4. The apparatus of claim 1, wherein the plurality of pins comprise pins used for testing an operation of the driver IC.

5. The apparatus of claim 1, wherein the driver IC drives a panel for a mobile terminal, which supports resolutions of at least one of QQVGA (160×120), QCIF (176×144), QCIF+ (176×200), QVGA (320×240), CIF (352×288), VGA (640×480), and XGA (1,024×768).

6. The apparatus of claim 1, wherein the controller comprises a controller for a mobile terminal.

7. The apparatus of claim 1, further comprising a memory for storing information about each of a plurality of types of panels.

8. The apparatus of claim 1, wherein the plurality of pins comprises pins at least one of a test pin, a ground pin, a power pin, and an output pin.

9. The apparatus of claim 1, wherein the controller applies a drive signal to the driver IC and checks the output signal provided from the driver IC a predefined period of time after the drive signal is applied to the driver IC.

10. The apparatus of claim 1, further comprising a Flexible Printed Circuit Board (FPCB) for electrically connecting the driver IC and the controller.

11. The apparatus of claim 1, wherein the output signal comprises at least one of a low signal, a high signal, and a signal that varies over time to be one of low and high.

12. A method for distinguishing a panel of a display device, the method comprising:

outputting, by a driver Integrated Circuit (IC) to which a panel is joined and on which a metal pattern is formed, an output signal that is changed according to a type of the metal pattern;

determining, by a controller, a type of the panel depending on the output signal; and applying, by the controller, a control signal corresponding to the determined type of the panel to the driver IC.

13. The method of claim 12, further comprising:

outputting at least one of acoustic information and visual information indicating that the type of the panel has been distinguished.

14. The method of claim 12, wherein the drive IC includes a plurality of pins that are electrically connected differently according to a type of the panel, and the plurality of pins comprise pins used for testing an operation of the driver IC.

15. The method of claim 14, wherein the plurality of pins comprises pins at least one of a test pin, a ground pin, a power pin, and an output pin.

16. The method of claim 12, wherein the panel is a panel for a mobile terminal, which supports resolutions of at least one of QQVGA (160×120), QCIF (176×144), QCIF+(176×200), QVGA (320×240), CIF (352×288), VGA (640×480), and XGA (1,024×768).

17. The method of claim 12, wherein the controller comprises a controller for a mobile terminal.

18. The method of claim 12, wherein the determining, by the controller, of the type of the panel depending on the output signal comprises accessing a memory that stores information about each of a plurality of types of panels.

19. The method of claim 12, further comprising:

applying, by the controller, a drive signal to the driver IC; and checking, by the controller, the output signal provided from the driver IC a predefined period of time after the drive signal is applied to the driver IC.

20. The method of claim 12, wherein the output signal comprises at least one of a low signal, a high signal, and a signal that varies over time to be one of low and high.

* * * * *